US007124024B1

(12) United States Patent
Adelaide et al.

(10) Patent No.: US 7,124,024 B1
(45) Date of Patent: Oct. 17, 2006

(54) PORTABLE DEVICE SUPPLYING TOURIST INFORMATION

(75) Inventors: Jean-Michel Adelaide, St. Julien les Villas (FR); Benjamin Desmet, St. Julien les Villas (FR); Jean-Marc Peintre, St. Julien les Villas (FR)

(73) Assignee: Hoppy, Societe a Responsabilite Limitee, Rosieres (FR)

( * ) Notice: Subject to any disclaimer, the term of this patent is extended or adjusted under 35 U.S.C. 154(b) by 0 days.

(21) Appl. No.: 10/088,043

(22) PCT Filed: Sep. 14, 2000

(86) PCT No.: PCT/FR00/02550

§ 371 (c)(1),
(2), (4) Date: Jun. 19, 2002

(87) PCT Pub. No.: WO01/20577

PCT Pub. Date: Mar. 22, 2001

(30) Foreign Application Priority Data

Sep. 16, 1999 (FR) ..... 99/11795

(51) Int. Cl.
*G08G 1/0962* (2006.01)

(52) U.S. Cl. ..... 701/211; 342/357.13; 701/213

(58) Field of Classification Search ..... 701/207, 701/211, 213, 201; 707/104, 104.1; 340/995.24, 340/995.27, 996; 342/357.06, 357.07, 357.09, 342/357.13, 357.17
See application file for complete search history.

(56) References Cited

U.S. PATENT DOCUMENTS

| | | | | |
|---|---|---|---|---|
| 5,767,795 | A * | 6/1998 | Schaphorst | 340/988 |
| 5,802,492 | A * | 9/1998 | DeLorme et al. | 455/456.5 |
| 6,081,803 | A * | 6/2000 | Ashby et al. | 707/4 |
| 6,085,148 | A * | 7/2000 | Jamison et al. | 701/211 |
| 6,199,045 | B1 * | 3/2001 | Giniger et al. | 705/1 |
| 6,266,614 | B1 * | 7/2001 | Alumbaugh | 701/211 |
| 6,351,707 | B1 * | 2/2002 | Ichikawa | 701/209 |
| 6,360,167 | B1 * | 3/2002 | Millington et al. | 701/211 |
| 6,446,005 | B1 * | 9/2002 | Bingeman et al. | 701/215 |
| 6,552,682 | B1 * | 4/2003 | Fan | 342/357.09 |
| 2002/0047861 | A1 * | 4/2002 | LaBrie et al. | 345/733 |

* cited by examiner

*Primary Examiner*—Michael J. Zanelli
(74) *Attorney, Agent, or Firm*—Egbert Law Offices

(57) ABSTRACT

A mobile device to supply information, notably for tourism, to a user, has a storage device that is fragmented into sectors, each sector corresponding at least to one given geographic location and showing an address, a tracker of said device, capable of delivering positioning information, corresponding to the location wherein the device is situated, a processor capable of drawing up a reading instruction containing at least the address of the sector of the information to be supplied in relation the positioning information on the basis of one or several correspondence tables.

12 Claims, 2 Drawing Sheets

PORTABLE DEVICE SUPPLYING TOURIST INFORMATION

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The invention concerns a mobile device to supply information, notably for tourism, to a user.

BACKGROUND OF THE INVENTION

When traveling, when one wishes to obtain information regarding the location, one may first of all look up literary tourist guides. Nevertheless, this solution is rather impractical since it implies turning the pages of the guide constantly and dedicating some time to reading said guide.

To remedy these shortcomings, It has been suggested to use audio or video tape players in which one has loaded tapes with pre-recorded comments on the locations encountered during said travel.

It is obvious that such a solution may be cumbersome for the user who would then have to stop and switch his player on again constantly to avoid any delay between the information provided and his progress on the road. Consequently, as the driver has heard or seen comments too early or too late with respect to the speed of his progress, he does not know where he is any longer and gives up using said device.

It should be noted that, with the solutions mentioned above, the nature of the information available remains limited to the language and/or the subject chosen (history, architecture, gastronomy, leisure, . . . ).

Besides, in the guiding technology, vehicle guiding devices are already known, which enable positioning of said vehicles and/or recommending a particular route to the driver.

Nevertheless, such systems are developed for vehicles only and solely regard the route followed by said vehicle.

BRIEF SUMMARY OF THE INVENTION

The object of this invention is to suggest a mobile device to supply information, notably for tourism, to a user, which remedies the shortcomings mentioned above and enables automatic playing of all kinds of information in relation to the location in which the user is.

Another object of this invention is to suggest a mobile device to supply information, notably for tourism, to a user, able to process numerous types of information.

Another object of this invention is to suggest a mobile device to supply information, notably for tourism, to a user, which enables to adapt the type of information supplied to the user.

Another object of this invention is to suggest a mobile device to supply information, notably for tourism, to a user, which can be used on foot as well as in numerous types of vehicles.

Another object of this invention is to suggest a mobile device to supply information, notably for tourism, to a user, whose operation can be tailored to the user's wishes.

Another object of this invention is to suggest a mobile device to supply information, notably for tourism, to a user, able to operate in numerous types of environment.

Another object of this invention is to suggest a mobile device to supply information, notably for tourism, to a user, whose operation can be adjusted in case of failure.

Another object of this invention is to suggest a mobile device to supply information, notably for tourism, to a user, whose operation is open-ended to provide the user with assistance services.

Other objects and advantages of the invention will appear more clearly using the following description, which is given only for exemplification purposes and does not purport to restrict said invention.

The invention concerns a mobile device to supply information, notably for tourism, to a user, comprising at least:

- storage means, fragmented into sectors, each said sector gathering the information to be supplied and corresponding at least to one given geographic location and showing an address,
- tracking means of said device, capable of delivering so-called positioning information, corresponding to the location in which said device is situated,
- processing means, capable of drawing up a reading instruction containing at least the address of the sector of the information to be supplied in relation at least to said positioning information, on the basis of one or several correspondence tables comprised in said device and associating at least the address of said sector and said positioning information regarding the some geographic location,
- reading means for at least the information contained in the sector showing the address of said reading instruction, which is delivered to them by said processing means, so-called selected information, and
- playing means capable of transmitting said selected information, in order to be supplied to the user in the form of messages regarding at least the location where he is.

BRIEF DESCRIPTION OF THE SEVERAL VIEWS OF THE DRAWINGS

The invention will be better understood when reading the following description, with the appended drawings which are part thereof.

DETAILED DESCRIPTION OF THE INVENTION

The invention concerns a mobile device to supply information, notably for tourism, to a user.

By "mobile" is meant usable for displacement by any means of locomotion, i.e. for example, which can be on-board a vehicle, notably an automotive vehicle, or still carded by a user on foot.

Figure 1:
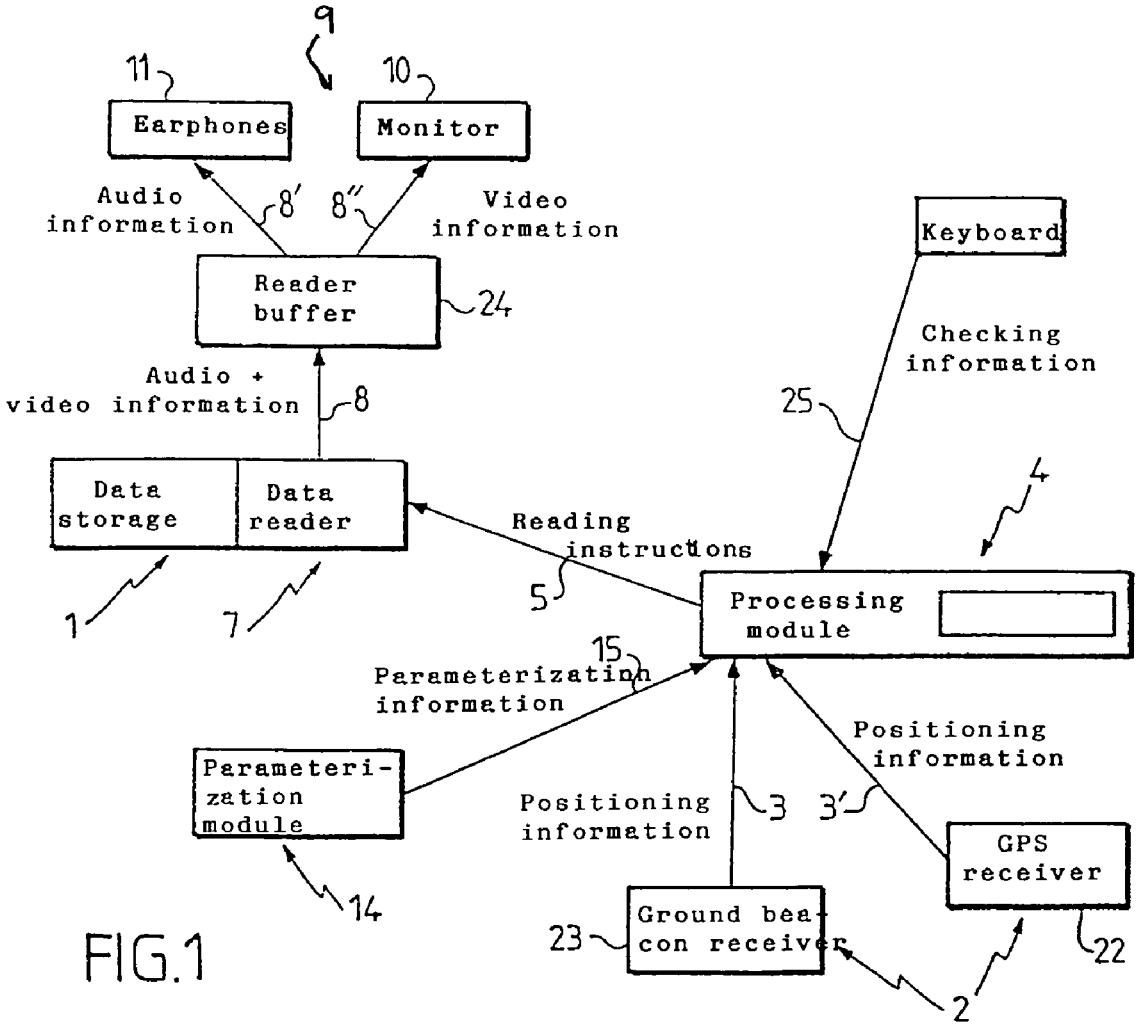
FIG. 1 is a diagrammatic functional illustration of an embodiment of the device according to the invention.

As illustrated on FIG. 1, the device according to the invention comprises at least storage means 1, fragmented into sectors, each said sector gathering the information to be supplied and corresponding at least to one given geographic location. Besides, each said sector shows an address.

The information contained in said storage means depends, notably, on the route or tour that the user intends to follow. This information may be derived, for example, from one or several databases wherein the requested information has been selected. The number and the nature of the information available will depend, notably, on the capacities of said storage means 1.

The mobile device according to the invention also comprises tracking means 2 of said device, capable of delivering so-called positioning information 3, 3', corresponding to the location wherein said device is located.

The former still comprises processing means 4, capable of drawing up a reading instruction 5 containing at least the address of the sector of information to be supplied in relation at least to said positioning information 3, 3', on the basis of one or several correspondence tables 6, 6', comprised in said device and associating at least the address of said sector and said positioning information 3, 3' regarding the same geographic location.

Still according to the invention, said device comprises reading means 7 for at least the information contained in the sector showing the address of said reading instruction 5, which is delivered to them by said processing means 4, so-called selected information 8, 8', 8" as well as playing means 9, capable of transmitting said selected information.

One can also supply messages to the user, notably audio and/or visual messages, regarding at least the location where he is, automatically. Moreover, the architecture selected enables to maximize the processing operation.

Said playing means 9, notably intended for multimedia, consist, for example, of a monitor 10 and/or earphones 11. They enable to provide, among other things, road maps indicating the position of the user, the time remaining to the end of the current route or tour, text information, notably for tourism.

Said device has the form, for example, of a casing accommodating at least said storage means 1, said tracking means 2, said processing means 4, said reading means 7 and/or said playing means 9; 10, 11. Said casing can, notably, be hand-held and/or suspended from a belt in order to be carried at least on foot. It can be fitted with standalone power supply means.

According to a particular embodiment of the invention, the information to be supplied contained in each said sector correspond to one or several fields of one or several customization criteria such as, for example, the language and/or the subject of the messages played. For a given geographic location, said storage means will thus comprise, for example, the same message in different languages. They may also comprise different messages in relation to the subject selected (history, architecture, gastronomy, leisure, . . . ), whereas each of the messages of the different subjects may be provided besides in different languages.

Figure 2:
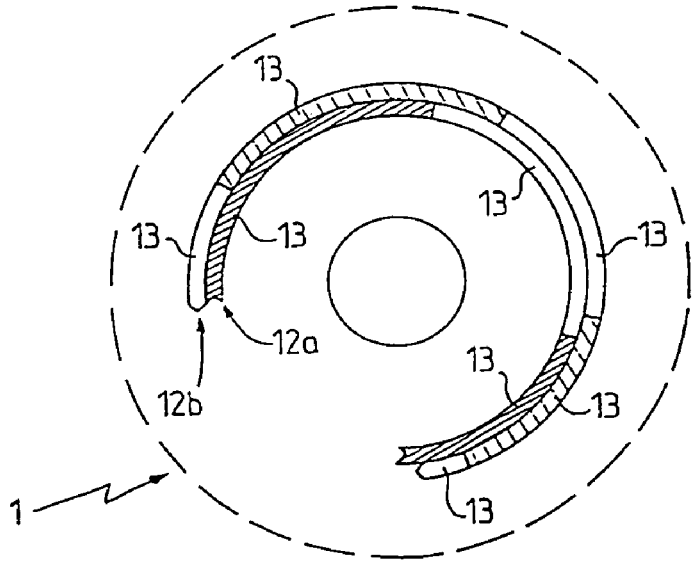
FIG. 2 is a diagrammatic illustration of an embodiment of storage means of the device according to the invention.

As illustrated on FIG. 2, when using a customization criterion, such as the language, said storage means 1 are divided into tracks 12*a*, 12*b*, each corresponding to one field of said criterion, such as French, English, German or others, whereas each track 12*a*, 12*b* is in turn divided in order to define said sectors 13 gathering the information to be supplied and corresponding to a given geographic location. When using several customization criteria, the tracks 12*a*, 12*b* corresponding each to a field of one of said customization criteria can be divided into successive segments, corresponding each to a field of one of the other selection criteria, as often as necessary.

The device according to the invention comprises moreover, for example, parameterization means 14, enabling the user to select the field required for each customization criterion.

Such a selection can be made, notably, when using the device, i.e. on a route or tour, by the user himself. It also may be made, for example, initially by a hirer, such as a tourist board or others, making such devices available to users.

Said parameterization means 14 consist, notably, of a keyboard enabling the user, or the hirer, to make his selection. Said keyboard can be arranged on said casing properly speaking or connected to said casing via an interface jack. Said parameterization means 14 provide, for example, so-called parameterization information 15, to said processing means 4, said parameterization information 15 depending on the selection made regarding the customization criterion or criteria.

Figure 3:
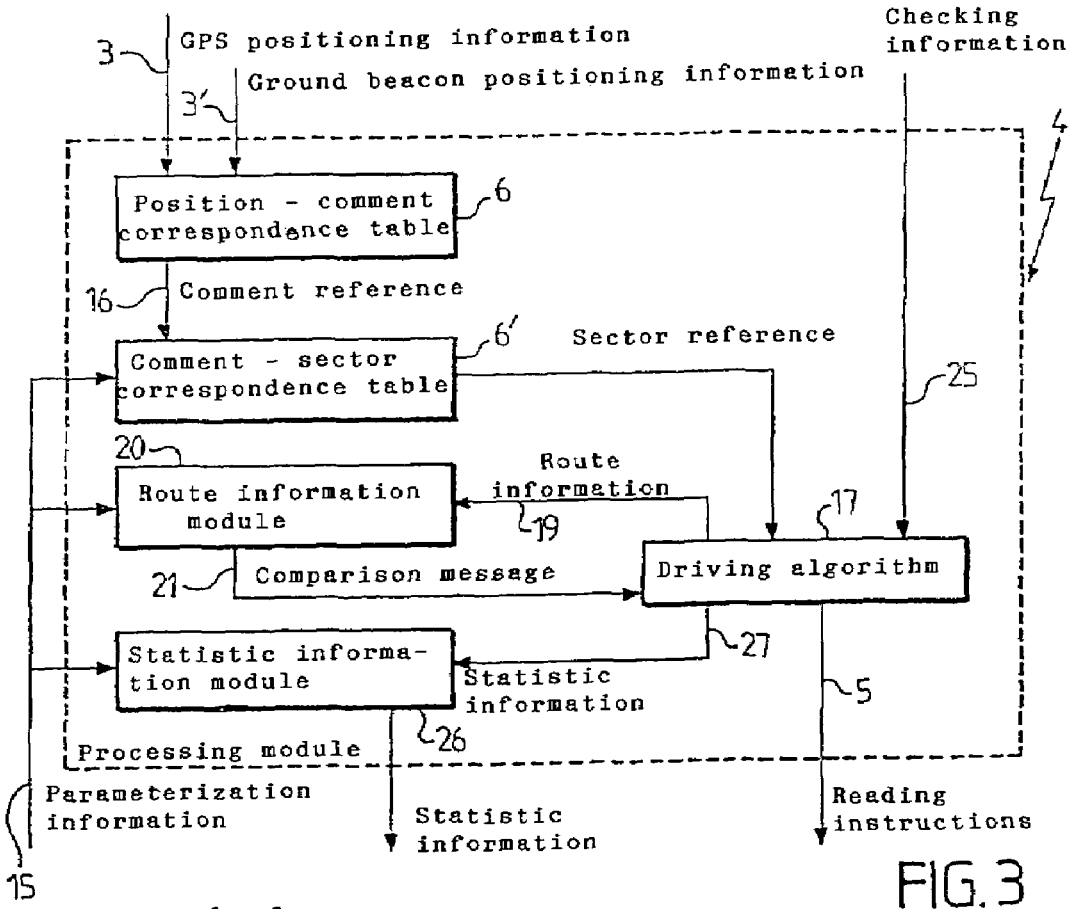
FIG. 3 is a detailed diagrammatic illustration showing one of the points of previous FIG. 1.

As illustrated on FIG. 3, said device comprises, for example, at least two said correspondence tables 6, 6'. The first table 6 associates, notably, said positioning information 3, 3' and a so-called comment reference 16, covering all the sectors 13 containing information to be supplied, regardless or the field(s) or selection criteria used, regarding the same geographic location. The second table 6' associates, notably, said comment reference 16 and the address of the sector 13 regarding the information to be supplied in relation to the fields selected, on the basis of said parameterization information 15.

The processing means 4 may also establish a reading instruction 5 containing the accurate address of the sector of the storage means to be used.

According to such an embodiment, it can be noted that all the pieces of information on the route or tour to follow, regardless of the customization criterion selected, are stored in said storage means 1. The device according to the invention thus enables minimizing the number of information storage media compared to a solution according to which, for each customization criterion, one would require storage means 1 whereof the content is different. Besides, successive usage of the correspondence tables 6, 6' promotes information processing.

Said correspondence tables 6, 6' are, for example, provided initially in said storage means 1 and are copied and/or brought close to said processing means 4 when powering up the device at the beginning of the route and/or the tour affected.

Going back to the example given previously, a correspondence table between the languages selected and the tracks 12*a*, 12*b* existing on the storage means 1 is this provided initially in said storage means, then brought close and/or copied to said processing means 4 when powering up the device. Consequently, during the route and/or tour followed by the user, each time said user is in a geographic location for which messages are available in said storage means 1, the positioning information 3, 3' provided by said tracking means is associated with a sector of the track affected and the corresponding message is played in the language selected.

Said storage means 1 are, possibly, removable. They can be, for example optic discs, notably versatile digital discs (DVDs) or flash memories, PCMCIA cards or others.

Said processing means 4 are, for example, capable of scanning permanently the positioning information 3, 3' delivered by said tracking means 2 in order to determine the address of the sector 13 of the information to be supplied as soon as one piece of the positioning information 3, 3' delivered can be associated with one or several sector addresses 13.

Said reading means 7 are capable, for example, of being actuated as soon as a reading instruction 5 is transmitted to them by said processing means 4 to take into account the information selected via direct access to said storage means 1.

As illustrated more particularly on FIG. 3, said processing means 4 may comprise guiding means 17 for the reading means 7, intended for drawing up said reading instruction 5 and capable of storing at least the list of the sector addresses 13 already read by said processing means 4 in a memory unit. Simultaneously, said processing means 4 are provided in order to compare the address of the sector 13 of the information to be supplied with the content of said list, whereby said guiding means 17 are also capable, for their own part, of delivering, to said reading means 7, a reading instruction 5 containing the address of a sector 13 of the storage means 1 containing a standby message to be played when the comparison puts in evidence that said sector 13 has already been read.

Said memory unit containing the list of addresses of the sectors 7 already read is situated, for example, at said processing means 4. It is updated, notably, via a route information 19 containing the address provided to said guiding means 17 via said correspondence tables 6, 6'. Said route information 19 is processed by a route information module 20 containing said list of sectors already read. In order to transmit a comparison message 21 towards guiding means 17 specifying whether the sector corresponding to the positioning information 3, 3' provided by the tracking means has already been read.

Said standby message consists, for example, of a music and/or text sequence.

Said guiding means 17 are capable moreover, possibly, of delivering to the reading means 7 a reading instruction 5 containing the address of a sector 13 of the storage means 1 comprising a message to be played when said positioning information 3, 3' is unknown in said correspondence table(s) 6, 6' and/or when no positioning information reaches the device.

It may be, notably, the same message as that transmitted when determining a sector address already read, of all other types of messages.

Said tracking means 2 consist, for example, of a satellite positioning module 22 (GPS) and/or a ground beacon positioning module 23, notably a Hertzian, infrared or laser beacon positioning module. They enable thus to cover a vast number of different geographic locations, in the countryside, in cities or even inside a building.

Said processing means 4 may also process first of all the information from the ground beacon positioning modules 23.

With reference again to FIG. 1, it can be noted that the device according to the invention may also comprise, for example, a buffer 24, capable of recording at least partially the information selected by said reading means 7, of checking said information for integrity and of restoring integrity in case of failures, to enable the transmission of said information selected by said playing means 9 after checking and possible restoration.

Thus, high quality audio or video messages can be provided, continuously and smoothly.

The device according to the invention may also comprise means for checking the succession of the pieces of information selected by said reading means 7. Said checking means are capable, for example, of authorizing the message to be repeated and/or the message to be skipped regarding said means and/or still to pause during the delivery of said messages. Said checking means are actuated, for example, at the keyboard.

They deliver checking information 25 intended for the guiding means 17 to influence the reading instruction 5 established.

As illustrated on FIG. 3, the device according to the invention tray also comprise an additional message unit 26 for storing information for statistical purposes. This is, for example, a statistic information module receiving statistic information 27 containing the address of the sectors to be read, from processing means 4. The statistic processing means may also take into account, possibly, the parameterization information 15.

Figure 4:
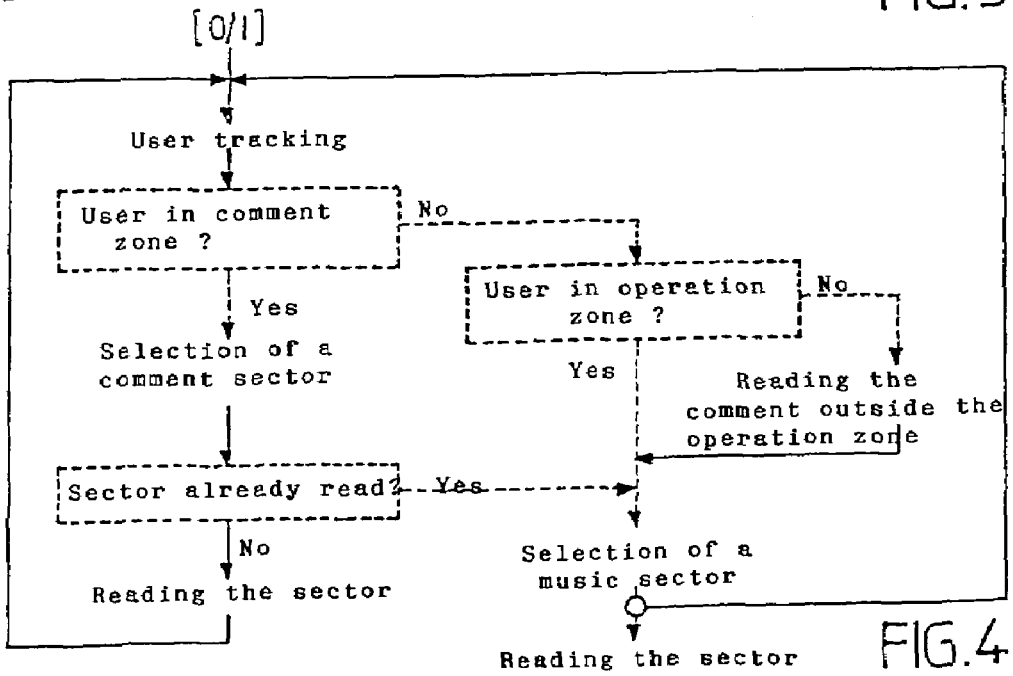
FIG. 4 is a diagrammatic algorithm illustrating an operating example of the device according to the invention.

With reference to FIG. 4, it can be noted that the device according to the invention operates, for exemplification purposes, as follows. The processing means 4 scan permanently to detect whether positioning information 3, 3' is received from the tracking means 2 and whether it corresponds to a message to be delivered, or not, i.e. to the address of one of the sectors 13 of the storage means 1. If such is not the case, they then transmit a standby message. Conversely, if such is the case, they examine whether the corresponding message has already been read. If the message has already been read, a standby message is then also played. If it has not been read, the message corresponding to the geographic location associated is played according to the choices made for the selection criterion or criteria.

The device according to the invention may also comprise, possibly, assistance means for the user. Said assistance means are capable, notably, of causing the information contained in the storage means 1 to be taken into account, in all or in part, by said reading means 7, independently of the information provided by said tracking means 2, to release the delivery of the messages, in all or in part, at any time requested by the user, regardless of his position. Said user can then listen to and/or visualize all the information available before, during or after his route or tour.

Said assistance means may also consist, among other things, of means for connection to an external information communication network, notably the Internet and/or for connection to calling centers. Said calling centers may also enable, notably, to download storage means 1.

Obviously, other embodiments, understandable to the man of the art, could also have been considered without departing for the framework of the invention.

We claim:

1. A mobile device to supply information for tourism to a user comprising:

a storage means fragmented into sectors, said storage means for gathering the information to be supplied and for having each sector corresponding at least to one given geographic location and for showing an address associated therewith;

a tracking means for delivering positioning information corresponding to a location in which the device is situated;

a processing means for drawing up a reading instruction containing at least the address of the sector of the information to be supplied in relation to said positioning information based on at least one correspondence table, the correspondence table associating at least the address of the sector and the positioning information regarding the corresponding geographic location;

a reading means for reading the information contained in the sector, said reading means for a showing an address of a reading instruction delivered by said processing means;

a playing means for transmitting the information selected in order to provide the user with messages regarding the geographic location in which the user is located, said processing means comprising a guiding means for the reading means, said guiding means for drawing up the reading instruction and for storing a list of addresses of the sectors already read in a memory unit, said processing means for comparing an address of the sector of the information to be supplied with the content of said list, said guiding means for delivering a reading instruction to the reading means, said reading instruction containing the address of a sector of said storage means, said reading instruction having a standby message to be played when the comparing indicates the sector has already been read by said reading means.

2. The device according to claim 1, wherein the information to be supplied contained in each sector corresponds to at least one field of a customization criteria, the device further comprising:

a parameterization means for enabling the user to select the field for the customization criteria, said at least one correspondence table comprising at least two correspondence tables, one of said two correspondence tables associating the positioning information and a comment reference for all the sectors containing information to be supplied regardless of the field or the selection criteria used regarding the same geographic location, another of said two correspondence tables associating said comment reference and the address of the sector regarding the information to be supplied in relation to the fields selected.

3. The device according to the claim 1, said storage means being removable.

4. The device according to claim 1, said processing means for scanning continuously the positioning information delivered by said tracking means in order to determine the address of the sector of the information to be supplied as soon as one piece of the positioning information delivered by said tracking means corresponds with at least one sector address.

5. The device according to claim 1, said reading means for actuating as soon as a reading instruction is transmitted to said reading means by said processing means in order to take into account the information selected from said storage means.

6. The device of claim 1, said guiding means for delivering a reading instruction to said reading means, said reading instruction containing the address of a sector of the storage means, said playing means for playing a message when said positioning information is unknown in said correspondence table and or when no positioning information is received.

7. The device according to claim 1, said tracking means comprising at least one of a satellite positioning module and a ground beacon positioning module.

8. The device according to claim 7, said processing means for processing initially information from said ground beacon positioning module.

9. The device according to claim 1, further comprising:

means for checking a succession of the information selected by said reading means, said means for checking for at least authorizing the message to be repeated and to be skipped and to pause during a delivery of the message.

10. The device according to claim 1, further comprising:

assistance means for assisting the user, said assistance means for causing the information contained in said storage means to be taken at least partially into account by said reading means independently of the information provided by said tracking means, said assistance means for releasing at least partially a delivery of the messages at any time requested by the user.

11. The device according to claim 10, wherein said assistance means comprises a connection to an external information communication network.

12. A mobile device to supply information for tourism to a user comprising:

a storage means fragmented into sectors, said storage means for gathering the information to be supplied and for having each sector corresponding at least to one given geographic location and for showing an address associated therewith;

a tracking means for delivering positioning information corresponding to a location in which the device is situated;

a processing means for drawing up a reading instruction containing at least the address of the sector of the information to be supplied in relation to said positioning information based on at least one correspondence table, the correspondence table associating at least the address of the sector and the positioning information regarding the corresponding geographic location;

a reading means for reading the information contained in the sector, said reading means for showing an address of a reading instruction delivered by said processing means;

a playing means for transmitting the information selected in order to provide the user with messages regarding the geographic location in which the user is located; and a buffer means for recording at least partially the information selected and for checking said information selected for integrity and for restoring the integrity in case of a failure so as to enable the transmission of said information selected by said playing means after the steps of checking and restoring.

* * * * *